US011117393B2

(12) United States Patent
Nishimura et al.

(10) Patent No.: US 11,117,393 B2
(45) Date of Patent: Sep. 14, 2021

(54) BLOWER, DRYER, AND PRINTER

(71) Applicants: Hideaki Nishimura, Kanagawa (JP); Toshihiro Yoshinuma, Kanagawa (JP); Ken Onodera, Kanagawa (JP)

(72) Inventors: Hideaki Nishimura, Kanagawa (JP); Toshihiro Yoshinuma, Kanagawa (JP); Ken Onodera, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/688,659

(22) Filed: Nov. 19, 2019

(65) Prior Publication Data

US 2020/0164663 A1 May 28, 2020

(30) Foreign Application Priority Data

Nov. 27, 2018 (JP) ..... JP2018-221608

(51) Int. Cl.
*B41J 11/00* (2006.01)
*F26B 21/00* (2006.01)
*B41M 7/00* (2006.01)

(52) U.S. Cl.
CPC ..... *B41J 11/002* (2013.01); *B41M 7/009* (2013.01); *F26B 21/004* (2013.01); *B65H 2301/517* (2013.01)

(58) Field of Classification Search
CPC ..... B41J 11/002; B41J 2/1714; B41J 2/2107
See application file for complete search history.

(56) References Cited

U.S. PATENT DOCUMENTS 5,854,642 A * 12/1998 Takahashi ..... B41J 2/2107 347/40
6,463,674 B1 * 10/2002 Meyers ..... B41J 11/002 34/304
6,705,672 B2 * 3/2004 Shikata ..... B60H 1/00528 296/208
8,808,482 B2 * 8/2014 Qi ..... B29C 65/02 156/188
2004/0065096 A1 * 4/2004 Sakuma ..... F24F 3/056 62/160
2010/0188469 A1 * 7/2010 Ikegami ..... B41J 11/0015 347/102
2016/0101635 A1 4/2016 Hoshino et al.
2017/0173974 A1 6/2017 Hoshino et al.
2017/0266991 A1 9/2017 Onodera et al.
2018/0141348 A1 5/2018 Hoshino et al.
2019/0100031 A1 4/2019 Nishimura et al.
2019/0263143 A1 8/2019 Nishimura et al.
2019/0283463 A1 9/2019 Nishimura et al.

FOREIGN PATENT DOCUMENTS

JP 2010-173177 8/2010
JP 2018-066552 4/2018

* cited by examiner

*Primary Examiner* — Lam S Nguyen
(74) *Attorney, Agent, or Firm* — Duft & Bornsen, PC

(57) ABSTRACT

A blower includes a blowout port configured to blow air outside the blower, a channel member connected to the blowout port, the channel member configured to guide the air to the blowout port, a first heat insulation member configured to cover an inner wall of the channel member, and a second heat insulation member configured to cover an outer wall of the channel member.

10 Claims, 4 Drawing Sheets

BLOWER, DRYER, AND PRINTER

CROSS-REFERENCE TO RELATED APPLICATION

This patent application is based on and claims priority pursuant to 35 U.S.C. § 119(a) to Japanese Patent Application No. 2018-221608, filed on Nov. 27, 2018, in the Japan Patent Office, the entire disclosure of which is hereby incorporated by reference herein.

BACKGROUND

Technical Field

Aspects of the present disclosure relate to a blower, a dryer, and a printer.

Related Art

As a printer to apply liquid onto a printing object such as a rolled sheet, continuous sheet, web, or the like to perform printing, for example, there is a printer including a dryer to accelerate drying of the applied liquid on the printing object.

The printer includes a heating dryer, a cooler, and a duct. The heating dryer includes a hot air outlet from which hot air is blown onto the printing object (recording medium). A temperature of the hot air is higher than a normal temperature. The cooler includes a cold air outlet from which cold air is blown onto the printing object (recording medium). A temperature of the cold air is lower than the temperature of the hot air. The duct guides the airflow. The duct that blows the hot air includes a wall made of a heat insulation material. The duct that blows the cold air include a wall made of the heat insulation material.

SUMMARY

In an aspect of this disclosure, a blower includes a blowout port configured to blow air outside the blower, a channel member connected to the blowout port, the channel member configured to guide the air to the blowout port, a first heat insulation member configured to cover an inner wall of the channel member, and a second heat insulation member configured to cover an outer wall of the channel member.

In another aspect of this disclosure, a blower includes a blowout port configured to blow air outside the blower, a channel member connected to the blowout port, the channel member configured to guide the air to the blowout port, a resin form covering an inner wall of the channel member, and a nonwoven fabric covering an outer wall of the channel member.

BRIEF DESCRIPTION OF THE DRAWINGS

The aforementioned and other aspects, features, and advantages of the present disclosure will be better understood by reference to the following detailed description when considered in connection with the accompanying drawings, wherein.

Figure 1:
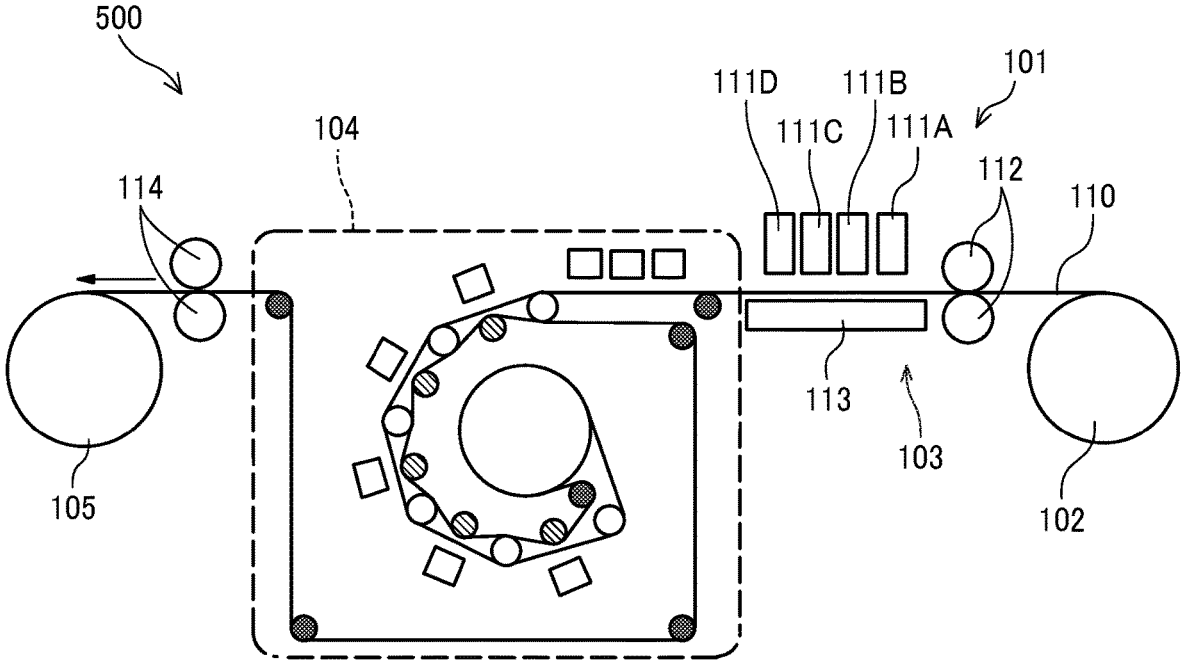
FIG. 1 is a schematic side view of a printer according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in an analogous manner, and achieve similar results.

Although the embodiments are described with technical limitations with reference to the attached drawings, such description is not intended to limit the scope of the disclosure and all the components or elements described in the embodiments of this disclosure are not necessarily indispensable. As used herein, the singular forms "a", "an", and "the" are intended to include the plural forms as well, unless the context clearly indicates otherwise.

Referring now to the drawings, wherein like reference numerals designate identical or corresponding parts throughout the several views, embodiments of the present disclosure are described below. First, a printer according to a first embodiment of the present disclosure is described with reference to FIG. 1. FIG. 1 is a schematic side view of the printer.

The printer 500 is an inkjet recording apparatus, and includes a liquid application unit 101 including a liquid discharge head, which is a liquid applicator, to discharge and apply ink, which is a liquid of desired color, onto a continuous sheet 110 as a printing object (object to be dried).

The liquid application unit 101 includes, for example, full-line heads 111A, 111B, 111C, and 111D for four colors arranged from an upstream side in a conveyance direction of the continuous sheet 110. Each heads 111 applies liquids of black K, cyan C, magenta M, and yellow Y onto the continuous sheet 110, respectively. Note that the number and types of color are not limited to the above-described four colors of K, C, M, and Y and may be any other suitable number and types.

The continuous sheet 110 is fed from a feeding roller 102, is sent onto a conveyance guide 113 by conveyance rollers 112 of a conveyance unit 103, and is guided and conveyed (moved) by the conveyance guide 113. The conveyance guide 113 is disposed to face the liquid application unit 101.

The continuous sheet 110 onto which the liquid is applied by the liquid application unit 101 is sent by an ejection roller 114 through a dryer 104 as a dryer according to the present embodiment, and is wound around a winding roller 105.

Figure 2:
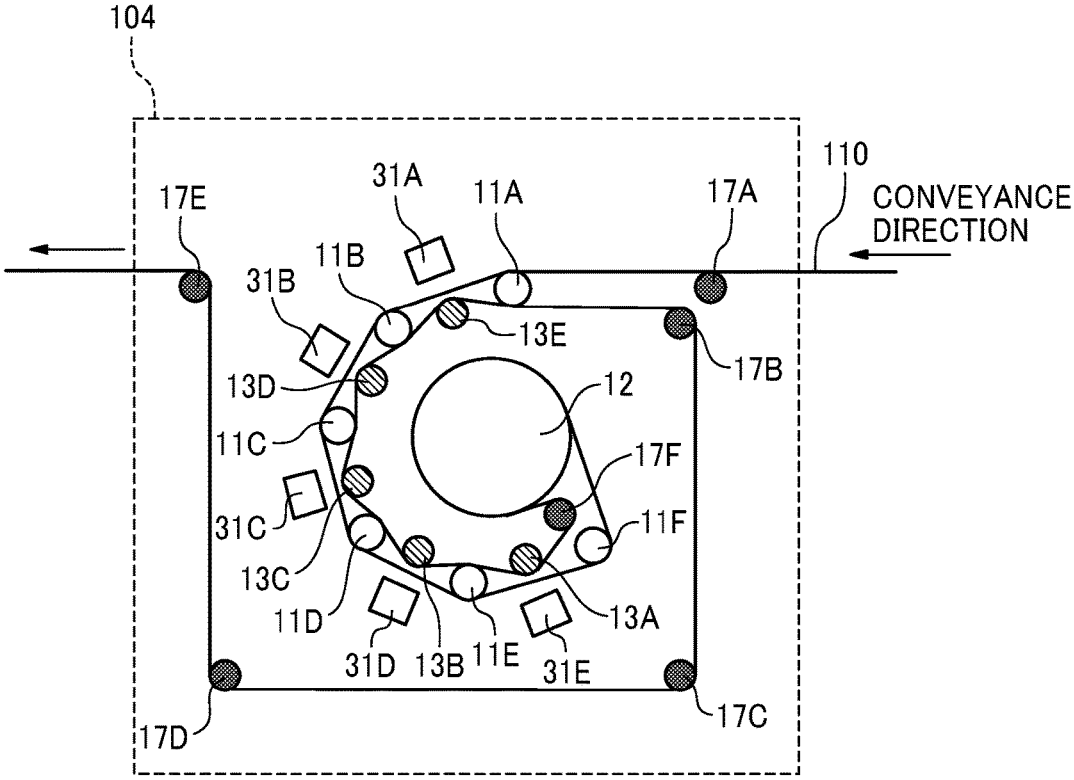
FIG. 2 is enlarged cross-sectional view of a dryer according to the first embodiment of the present disclosure.

Next, the dryer 104 according to the first embodiment is further described with reference to FIG. 2. FIG. 2 is an enlarged explanatory view of the dryer 104.

The dryer 104 includes heating rollers 11A to 11F that is a plurality of contact heaters including a curved surface to contact and heat the continuous sheet 110, and a heating drum as a contact heater including a curved contact face to also contact the continuous sheet 110. The heating rollers 11A to 11F is also collectively referred to as the heating rollers 11.

Further, the dryer 104 includes a guide roller 13A, which is a contact guide to guide the continuous sheet 110 to the heating roller 11E, on the downstream side of the heating drum 12 and guide rollers 13B to 13E (pressing rollers), which are contact guides to guide the continuous sheet 110 guided by the guide roller 13A to come into contact with the heating rollers 11E to 11A.

Here, the plurality of heating rollers 11 (11A to 11F) are disposed around the heating drum 12 in a circular arc arrangement. The heating rollers 11A to 11E may have the same diameter or different diameters. Further, the guide rollers 13B to 13E are disposed between the adjacent heating rollers 11.

The plurality of heating rollers 11, the heating drum 12, and the plurality of guide rollers 13 constitute a heating conveyance path (conveyance path) to heat the continuous sheet 110. The continuous sheet 110 is conveyed while contacting an outer peripheral side of the plurality of heating rollers 11 arranged in the circular arc arrangement on the upstream side of the heating drum 12. Then, the guide rollers 13 conveys the continuous sheet 110 passed through the heating drum 12 while the continuous sheet 110 contacts again an inner side (the side of the heating drum 12) of the plurality of heating rollers 11.

The dryer 104 includes blowers 31 (31A to 31E) that blows an airflow at an ambient temperature on a liquid application surface of the continuous sheet 110. The blowers 31 are arranged on an outer peripheral side of the plurality of heating rollers 11.

Further, the dryer 104 includes a guide roller 17A to guide the continuous sheet 110 inside the dryer 104, a guide roller 17F to guide the continuous sheet 110 that passes through the heating drum 12 to a guide roller 13A, and a plurality of guide rollers 17 (17B to 17E) to guide the continuous sheet 110 that passes through guide roller 13E outside the dryer 104.

In a flow of a drying process in the dryer 104 thus configured, the heating roller 11 heat a surface of the continuous sheet 110 opposite the liquid application surface while the blowers 31 blow the airflow at an ambient temperature on the liquid application surface of the continuous sheet 110 to dry the liquid application surface of the continuous sheet 110.

Next, the heating drum 12 disposed inside the plurality of heating rollers 11 contacts and heats the surface opposite the liquid application surface of the continuous sheet 110 while the continuous sheet 110 is wound around the heating drum 12.

Then, the guide rollers 13 contact the liquid application surface of the continuous sheet 110 while the heating rollers 11 contact and heat the surface opposite the liquid application surface of the continuous sheet 110 to dry the liquid applied on the continuous sheet 110. Thus, a plurality of identical heating rollers 11 of the dryer 104 according to the present disclosure contacts and heats the continuous sheet 110 as an object to be dried from different directions, that is, a direction from the liquid application surface and a direction from the surface opposite the liquid application surface of the continuous sheet 110.

Figure 3:
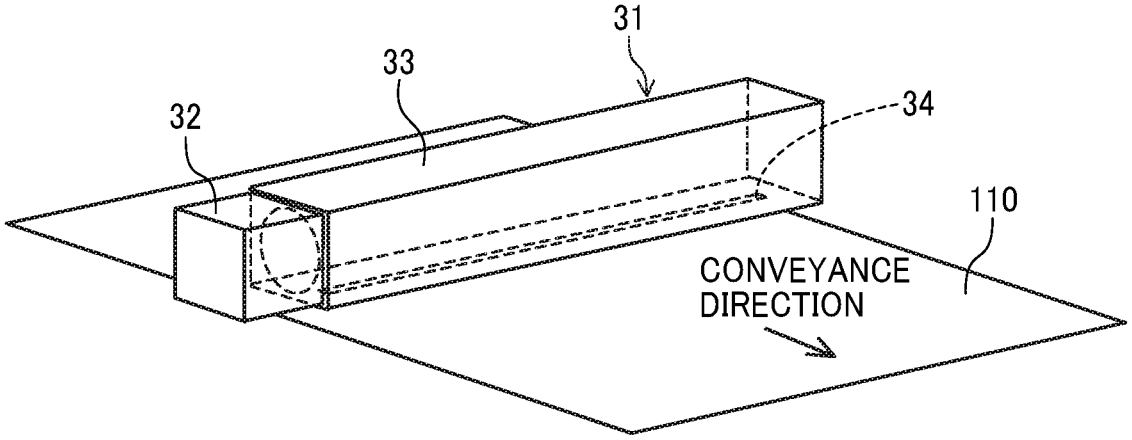
FIG. 3 is a schematic perspective view of a blower according to the first embodiment of the present disclosure.
Figure 4:
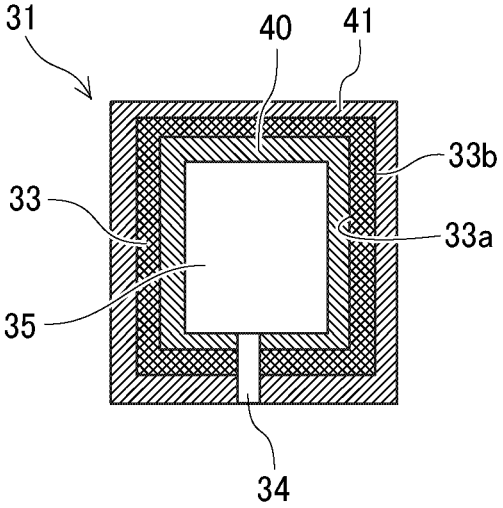
FIG. 4 is a cross-sectional view of a channel member in a transverse direction of the channel member of the blower in the first embodiment.

Next, the dryer 104 according to the first embodiment is further described with reference to FIGS. 3 and 4. FIG. 3 is a perspective view of the blower 31 of the first embodiment. FIG. 4 is cross sectional-view of a channel of the blower 31 in a transverse direction of the blower 31 in FIG. 3.

Each of the blowers 31 includes a nozzle 34 as a blowout port from which air is blown outside, a channel member 33 forming a channel 35 that guides the air to the nozzle 34, and a fan 32 as an air supplier to supply air to the channel member 33. The fan 32 is disposed at an air-supply port of the channel member 33.

The fan 32 supplies air at an ambient temperature in the dryer 104 to the channel member 33. The channel member 33 guides the air supplied from the fan 32 to the nozzle 34 and blows out the air from the nozzle 34. Blowing air at an ambient temperature from the nozzle 34 can reduce power consumption of the dryer 104.

The blower 31 includes heat insulation members 40 and 41 as members (materials) to reduce heat transfer on an inner wall 33*a* and an outer wall 33*b* of the channel member 33. The heat insulation members 40 and 41 are also referred to as heat insulation materials and heat insulators. The heat insulation member 40 covers the inner wall 33*a* of the channel member 33 (first heat insulation member). The heat insulation member 41 covers the outer wall 33*b* of channel member 33 (second heat insulation member).

Thus, the blower 31 includes the heat insulation members 40 and 41 not only on the inner wall 33*a* but also on the outer wall 33*b* so that the blower 31 can reduce a thickness of the heat insulation member 40 that narrows a cross-sectional area of the channel member 33 compared with a configuration in which the blower 31 includes the heat insulation member 40 having a required thickness only on the inner wall 33*a* of the channel member 33. Thus, the blower 31 can prevent an increase in resistance of the channel member 33.

Therefore, the blower 31 includes the blowout port (nozzle 34) to blow air outside the blower 31, a channel member 33 communicating with the blowout port (nozzle 34) to guide the air to the blowout port (nozzle 34), and the heat insulation member 40 and 41 to cover each of an inner wall 33*a* and an outer wall 33*b* of the channel member 33.

Further, the blower 31 includes the heat insulation member 41 also on the inner wall 33*a* so that the blower 31 can secure a required thickness as a whole compared with the blower 31 including the heat insulation member 41 having a required thickness only on the outer wall 33*b* of the channel member 33. Thus, the blower 31 can prevent an increase in an outer shape of the channel member 33 and an increase in a size of the blower 31.

Further, the continuous sheet 110 heated by the heating roller 11, for example, may generate vapor of solvent in the liquid that contacts the channel member 33. The heat insulation members 40 and 41 on the channel member 33 can prevent cooling of the outer wall 33*b* of channel member 33 even if air having an ambient temperature flows in the channel member 33. Thus, the blower 31 can prevent the vapor to be adhered on the outer wall 33*b* of the channel member to cause condensation.

Thus, the blower 31 can prevent deterioration in quality of image caused by dew of condensation falling on a printing surface of the continuous sheet 110 that blur the printed image.

The heat insulation member 40 on the inner wall 33*a* is preferably made of a resin foam. Examples of the resin foam include urethane foam, polystyrene foam, and rubber sponge. Using a resin foam having a low thermal conductivity as the heat insulation member 40 can further effectively prevent a temperature drop of a surface of the channel member 33 and prevent condensation adhered on the surface of the channel member 33.

The heat insulation member 41 on the outer wall 33*b* is preferably made of a nonwoven fabric. The nonwoven fabric is a sheet-like material intertwined with fibers. Aramid fibers, nylon fibers, polyester fibers, polypropylene fibers, polyolefin fibers, rayon fibers and the like can be used as the nonwoven fabric. Since the nonwoven fabric has a porous structure and has heat retaining properties, the nonwoven fabric corresponds to a heat insulation member that reduces heat transfer. Further, the nonwoven fabric has a water absorption property that can retain moisture in the nonwoven fabric. Thus, the nonwoven fabric can absorb moisture adhered onto the outer wall 33*b*. Thus, the heat insulation member 41 on (covering) the outer wall 33*b* can be made thinner than the heat insulation member 40 on (covering) the inner wall 33*a*. Thus, the blower 31 can prevent an increase in an outer shape of the channel member 33 and an increase in a size of the blower 31.

Next, a second embodiment of the present disclosure is described with reference to FIGS. 5 to 7.

Figure 5:
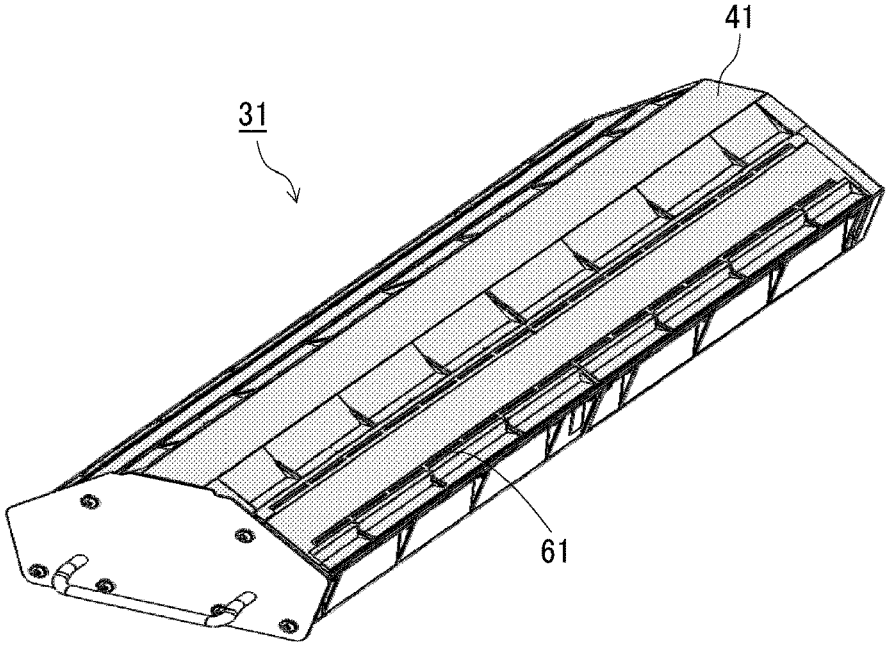
FIG. 5 is an external perspective view of a blower according to a second embodiment of the present disclosure.

FIG. 5 is an outer perspective view of the blower 31 according to the second embodiment.

Figure 6:
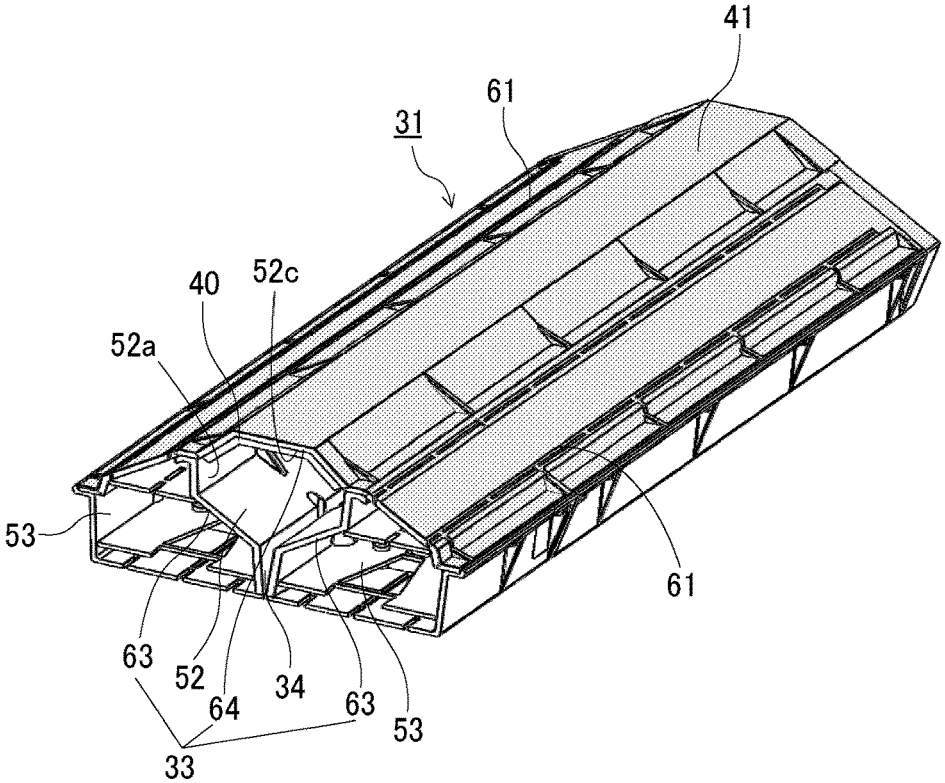
FIG. 6 is a schematic perspective view illustrating an internal configuration of the blower.

FIG. 6 is a schematic perspective view of the blower 31 illustrating an internal configuration of the blower 31.

Figure 7:
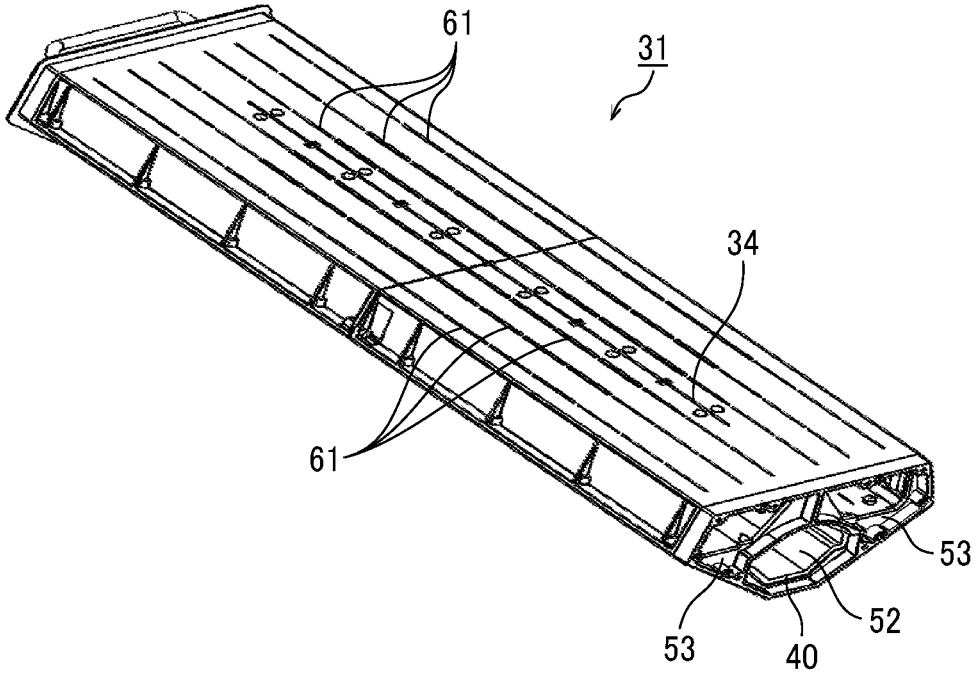
FIG. 7 is a schematic perspective view of the blower viewed from a blowout port.

FIG. 7 is a schematic perspective view of the blower 31 viewed from the blowout port.

The blower 31 in the second embodiment includes an air supply chamber 52 serving as a channel, a nozzle 34 serving as a blowout port communicating with the air supply chamber 52, and exhaust chambers 53 disposed on both sides of the air supply chamber 52 in the transverse direction of the blower 31. The channel member 33 in the second embodiment includes walls 63 and 64. The walls 63 partition the air supply chamber 52 and the exhaust chambers 53 disposed on both sides of the air supply chamber 52 in the transverse direction of the blower 31. The wall 64 partitions the air supply chamber 52 from outside the blower 31 at a portion of the air supply chamber 52 not surrounded by the exhaust chambers 53.

The exhaust chamber 53 includes an exhaust hole 61, and the exhaust hole 61 is connected to a suction fan via a duct.

The exhaust chamber 53 collects warm air containing moisture and solvent generated by heating the continuous sheet 110 with the heating roller 11. Since the exhaust chamber 53 is not cooled by the collected air, the heat insulation member 40 is not provided on an inner wall of the exhaust chamber 53.

Further, the warm air collected by the exhaust chamber 53 warms and do not cool the walls 63 that partition the air supply chamber 52 and the exhaust chambers 53 disposed on both sides of the air supply chamber 52. Thus, the blower 31 do not include a heat insulation member on an inner wall 52*a* of the walls 63 of the air supply chamber 52.

Conversely, the blower 31 includes the heat insulation member 40 that covers an inner wall 52*c* of the wall 64 that partitions the air supply chamber 52 from outside the blower 31.

Thus, the blower 31 can prevent condensation without excessively narrowing a width (open sectional area) of the air supply chamber 52 due to the thickness of the heat insulation member 40.

Further, the blower 31 includes the heat insulation member 41 made of a nonwoven fabric, for example, on (covering) the outer walls of the air supply chamber 52 and the exhaust chambers 53 indicated by areas illustrated in FIGS. 5 and 6. Thus, the blower 31 that includes the heat insulation member 41 made of nonwoven fabric on the outer wall can also collect the condensed droplets.

Further, the thickness of the heat insulation member 41 on (covering) the outer wall 33*b* is made thinner than the thickness of the heat insulation member 40 on (covering) the inner wall 33*a* of the channel member 33. The air that cools the channel member 33 of the blower 31 flows into the inner side of the channel member 33. Thus, an effect of prevention of cooling can be increased with increase of the thickness of the heat insulation member 40 on the inner wall. Thus, the same effect of prevention of cooling can be attained even if the heat insulation member 41 on the outer wall is thinned. Thus, the blower 31 can reduce the size of the entire blower 31.

Thus, the channel member 33 includes the air supply chamber 52 communicating with the blowout port (nozzle 34). The air supply chamber 52 blows out the air from the blowout port (nozzle 34). The exhaust chambers 53 are disposed adjacent to the air supply chamber 52. The exhaust chambers 53 take in the air outside the blower 31, and a temperature of an intake air taken into the exhaust chambers 53 is higher than a temperature of the air blown out from the blowout port (nozzle 34).

The inner wall of the air supply chamber 52 includes a first portion surrounded by the exhaust chamber 53, and a second portion not surrounded by the exhaust chamber 53, and the heat insulation member 40 covers the second portion of the inner wall 52*c* of the air supply chamber 52. The inner walls 52*a* is formed at the first portion at which the walls 63 are formed. The inner wall 52*a* is formed at the second portion that faces outside the blower 31.

The air supply chamber 52 faces the exhaust chamber 53 in the first portion, and the air supply chamber 52 does not face the exhaust chamber 53 in the second portion.

The blower 31 includes a plurality of exhaust chambers 53 disposed on both sides of the air supply chamber 52 in a transverse direction of the blower 31.

The blowout port (nozzle 34) is arranged at the first portion, and the blowout port (nozzle 34) is disposed between the plurality of exhaust chambers 53 (see FIG. 6). In other words, the blowout port (nozzle 34) is sandwiched between two exhaust chambers 53 in FIG. 6.

Further, the blowout port (nozzle 34) is disposed opposite to the inner wall 52*c* and the heat insulation member 40 via the air supply chamber 52 in FIG. 6.

The above-described embodiments describe examples of the object to be dried and the object to be printed using the continuous sheet. For example, a printed object, such as wallpaper or an electronic circuit board sheet (e.g., prepreg), may be used in addition to a continuous material, such as a continuous sheet, a roll sheet, and a web, and a recording medium (a printed object) such as an elongated sheet material.

The printer may print recording images such as characters and figures with a liquid such as ink on a printing object. Further, the printer may print an arbitrary image such as a pattern on the printing object for purposes such as decoration and decoration.

Herein, the liquid to be applied is not particularly limited, but it is preferable that the liquid has a viscosity of less than or equal to 30 mPa·s under a normal temperature and a normal pressure or by being heated or cooled. Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant. Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

When a liquid discharge head is used as the liquid applicator, examples of an energy generation source to discharge a liquid include an energy generation source using a piezoelectric actuator (a lamination piezoelectric element and a thin-film piezoelectric element), a thermal actuator using an electrothermal transducer element such as a heating resistor (element), a static actuator including a diaphragm plate and opposed electrodes, and the like.

The terms "printing" in the present embodiment may be used synonymously with the terms of "image formation", "recording", "printing", and "image printing".

Numerous additional modifications and variations are possible in light of the above teachings. Such modifications and variations are not to be regarded as a departure from the scope of the present disclosure and appended claims, and all such modifications are intended to be included within the scope of the present disclosure and appended claims.

What is claimed is:

1. A dryer comprising:

a heater configured to heat a continuous sheet of print media onto which a liquid is applied; and a blower disposed opposite to the heater with respect to the continuous sheet of print media and configured to blow air onto the continuous sheet of print media, the blower comprising:

a hollow body including an air supply chamber configured to expel air through the blower, one or more exhaust chambers configured to take in air from outside the blower, one or more side walls separating the air supply chamber and the one or more exhaust chambers, and an upper wall enclosing the air supply chamber from an external environment of the blower, wherein hollow passages of the air supply chamber and the one or more exhaust chambers extend in a longitudinal direction across a width of the continuous sheet of print media;

a blowout port including a slit extending in the longitudinal direction disposed on an underside of the hollow body to face the continuous sheet of print media and configured to blow air outside the blower from the air supply chamber;

a first heat insulation member disposed opposite to the slit and extending in the longitudinal direction on an inner side of the upper wall of the air supply chamber, wherein the one or more side walls separating the air supply chamber and the one or more exhaust chambers are uninsulated; and a second heat insulation member disposed opposite the blowout port on an outer side of the upper wall of the air supply chamber.

2. The dryer according to claim 1, wherein the first heat insulation member is made of a resin foam.

3. The dryer according to claim 1, wherein the second heat insulation member is made of a nonwoven fabric.

4. The dryer according to claim 1, wherein a thickness of the second heat insulation member is thinner than a thickness of the first heat insulation member.

5. The dryer according to claim 1, further comprising an air supplier configured to supply air to the air supply chamber.

6. The dryer according to claim 5, wherein the air supplier supplies, to the air supply chamber, the air at an ambient temperature inside an apparatus to which the blower is installed.

7. The dryer according to claim 1, wherein a temperature of the air taken into the exhaust chamber is higher than a temperature of the air blown out from the blowout port.

8. The dryer according to claim 1, further comprising a plurality of exhaust chambers disposed on both sides of the air supply chamber in a transverse direction of the blower.

9. The dryer according to claim 8, wherein the blowout port is disposed between the plurality of exhaust chambers.

10. A printer comprising:

a liquid application device configured to apply the liquid onto the continuous sheet of print media; and the dryer according to claim 1.

* * * * *